United States Patent [19]

Okazaki et al.

[11] 4,210,134

[45] Jul. 1, 1980

[54] PILLOW FOR MANUAL THERAPEUTICS

[75] Inventors: Yasukichi Okazaki; Tatsuo Okazaki, both of Kamifukuoka, Japan

[73] Assignee: Kabushikigaisha OMCO, Saitama, Japan

[21] Appl. No.: 932,485

[22] Filed: Aug. 10, 1978

[30] Foreign Application Priority Data

Mar. 30, 1978 [JP] Japan ..... 53-29859[U]
Jul. 12, 1978 [JP] Japan ..... 53-95799[U]

[51] Int. Cl.[2] ..... A61H 29/00

[52] U.S. Cl. ..... 128/24.1; 128/60; 128/67; 128/69

[58] Field of Search ..... 128/60, 24.1, 67–69, 128/57; 5/338

[56] References Cited

U.S. PATENT DOCUMENTS 1,250,392 12/1917 Vance ..... 128/68.1
1,981,379 11/1934 Thomson et al. ..... 128/69
1,984,520 12/1934 Curtis ..... 128/68.1
4,126,129 11/1978 Rainbow ..... 128/67

FOREIGN PATENT DOCUMENTS 1349109 12/1963 France ..... 128/24.1
18840 of 1912 United Kingdom ..... 128/60
1261540 1/1972 United Kingdom ..... 128/69

*Primary Examiner*—Lawrence W. Trapp
*Attorney, Agent, or Firm*—Frishauf, Holtz, Goodman & Woodward

[57] ABSTRACT

A pillow for manual therapeutics has an upper body substantially formed into a saddle-shape, and a plurality of protrusions symmetrically arranged on the surface of said upper body near the central portion thereof, so that the protrusions act as fingers for pressing on the affected parts of human head or body when the head or body is supported by the pillow.

21 Claims, 18 Drawing Figures

PILLOW FOR MANUAL THERAPEUTICS

The present invention relates to a pillow for manual therapeutics as a finger-pressing system.

An object of this invention is to provide a pillow for manual therapeutics capable of finger-pressing the human head or back.

Another object of this invention is to provide a pillow for manual therapeutics used alternatively for finger-pressing and cooling the human head or body.

The other features and advantages of this invention will be understood from the following description with reference to the accompanying drawings as follows.

Figure 14:
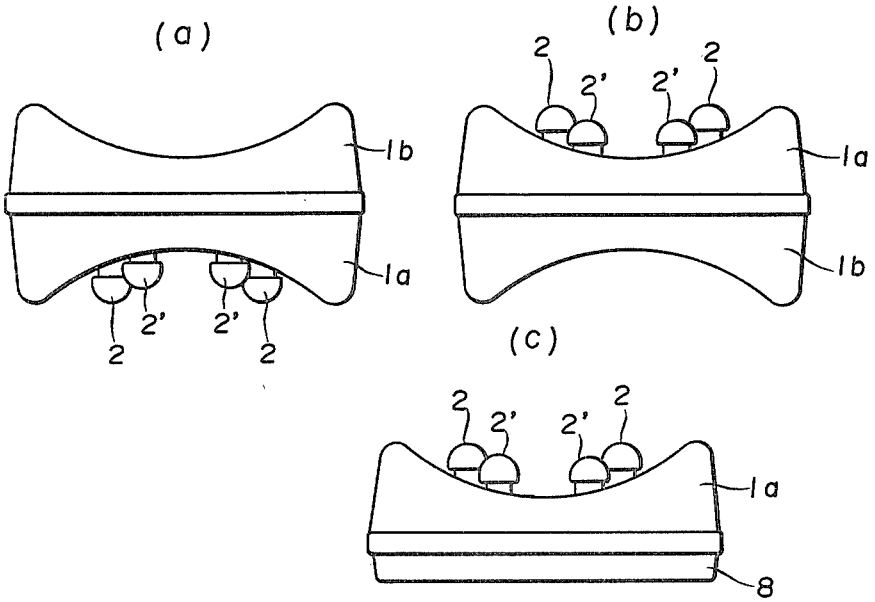
Figure 15:
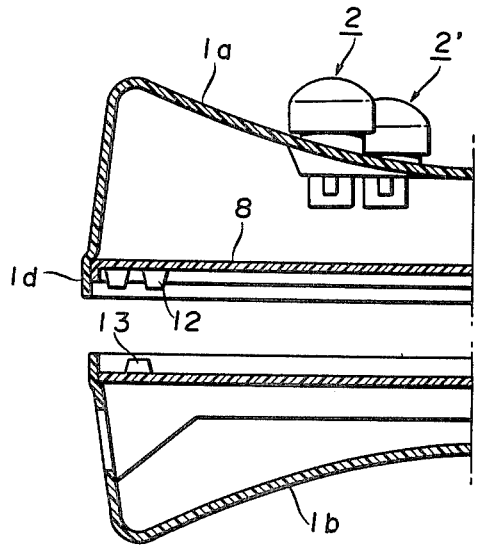
Figure 16:
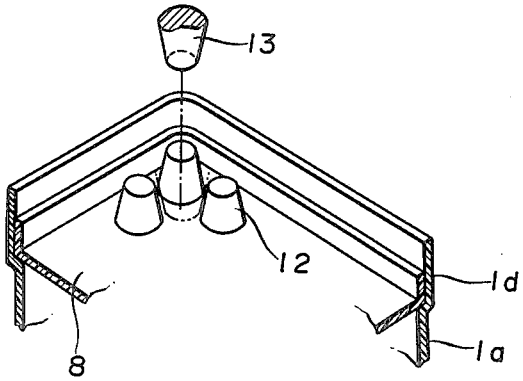

FIGS. 14(*a*), 14(*b*) and 14(*c*) are diagrammatic side views of the pillow in three-used conditions;

FIG. 15 is a vertical cross-section of a still further embodiment of this invention having a specific joint means, which is detached;

FIG. 16 is a perspective view of the joint means mentioned in FIG. 15, and

Figure 17:
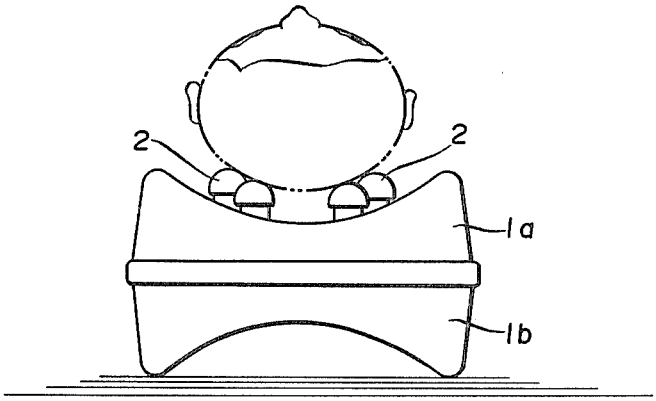
Figure 18:
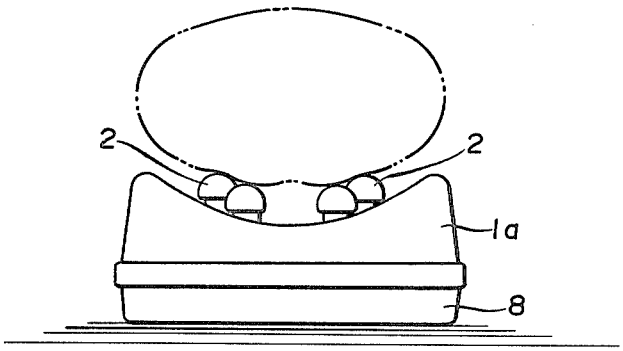

FIGS. 17 and 18 are diagrammatic side views in which the use conditions are indicated and illustrated for manual therapeutics.

Referring to FIGS. 1 to 5, there is provided a pillow for manual therapeutics embodying this invention.

Said pillow has a hollow pillow body 1 which is made of synthetic resin and which has an upper part 1*a* substantially formed into a saddle-shape and a lower part 1*b* formed into the same as said upper part 1*a* and heat radiant fins 1*c* integrally formed to the inner wall thereof.

Said pillow has a plurality of protrusions 2 symmetrically arranged on the surface of said upper body near the central portion thereof. Said protusions may be integral with the pillow body 1 or be detachable from said pillow body 1 in this embodiment. For the latter, there is provided a plurality of protrusion pieces 2 (2'), having different heights. Preferrably, the protrusions consist of two-line arranged pieces, each line of which includes a high level protrusion piece 2 in the middle position and two low level protrusion pieces 2' in both end positions. Each protrusion piece has a head 2*a* (2*a*') formed to the top thereof, a leg 2*b* (2*b*') formed to the tail thereof and a lock protrusion 2*c* (2*c*') formed to the side surface of said leg. In order to attach the protrusion piece 2 (2') to the upper body 1*a* of the pillow, the pillow includes a plurality of holes 3 which are provided for the same number of protrusion pieces. Each of the hole has a guide slit through 3*a* which the lock protrusion 2*c* (2*c*') penetrates so as to be guided to the inner side of the pillow shell. If necessary, the round edge of said hole includes a stepped portion 3*b* and a tapered portion 3*c* so that the lock protrusion is engaged with the stepped portion 3*b* and depressed by said tapered portion 3*c* when the leg 2*b* (2*b*') is completely inserted through the hole 3, and the protrusion piece is turned on the upper body of the pillow.

In this embodiment, there may be provided some windholes 4 formed to the side walls of the pillower so as to allow air-exchange to the inner portion surrounded by the pillow shell, whereby, the heat radiant from the fins 1*c* of the lower body 1*b* escapes with the air flow.

Figure 8:
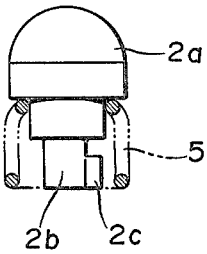
FIG. 8 is a side view of the modification of the protrusion piece.
Figure 10:
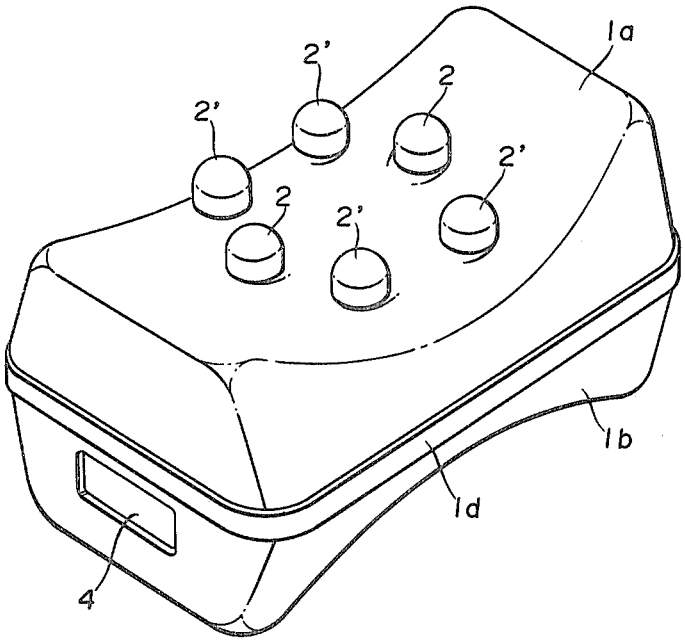
FIG. 10 is a perspective view of a pillow of a further embodiment of the present invention.
Figure 12:
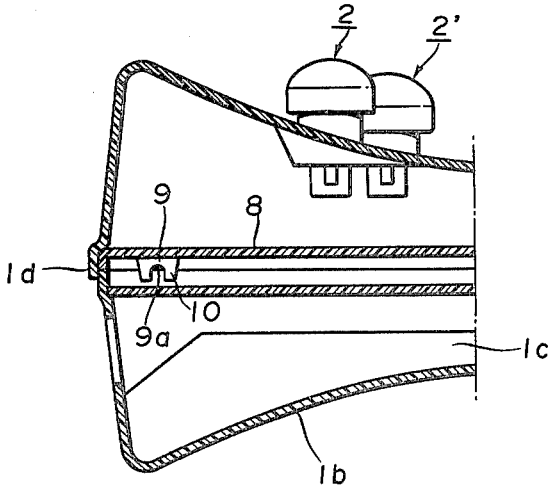
FIG. 12 is a vertical cross-section of the pillow of FIGS. 10 and 11.
Figure 11:
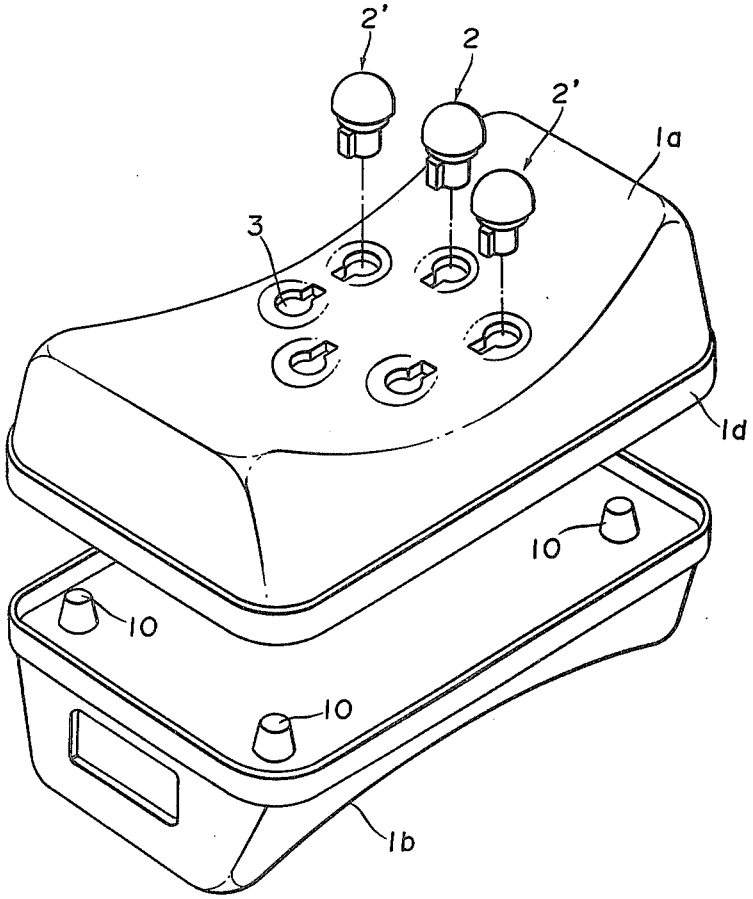
FIG. 11 is a perspective view of the pillow of FIG. 10 demounted.

In order to secure the protrusion piece to the pillow, the protrusion piece may be provided with a coiled spring 5 (as shown in FIG. 8) which surrounds the body of the protrusion piece and is clamped to the neck of the protrusion piece's body at one end thereof. Accordingly, the lock protrusion 2*c* (2*c*') contacts the surface of the round edge vertically and elastically, so that the lock protrusion 2*c* (2*c*') is prevented from over-turning the stepped portion 3*b* thereby preventing the wart piece 2 from detaching from the pillower body 1.

In order to co-operate with the heat-therapeutics, the protrusion piece 2 should include a heating element 6 embedded into the body thereof and energized by suitable electric means (not shown).

Figure 6:
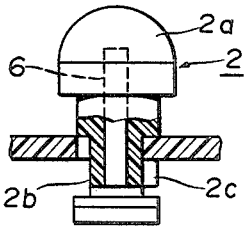
FIG. 6 is a vertical cross-section of the protrusion combined with a thermal-therapeutic element.
Figure 7:
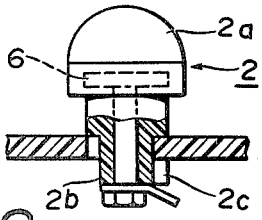
FIG. 7 is a vertical cross-section of the modification of the combined protrusion mentioned above.

Such the heating element 6 is shown in FIG. 6 and 7.

Figure 1:
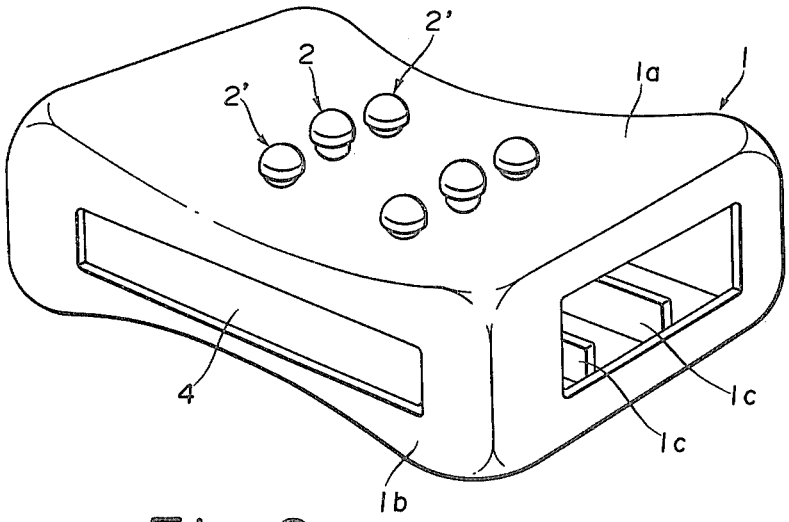
FIG. 1 is a perspective view of a pillow embodying the present invention.
Figure 2:
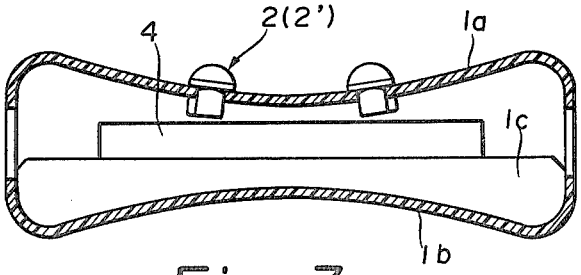
FIG. 2 is a vertical cross-section of the pillow of FIG. 1.
Figure 3:
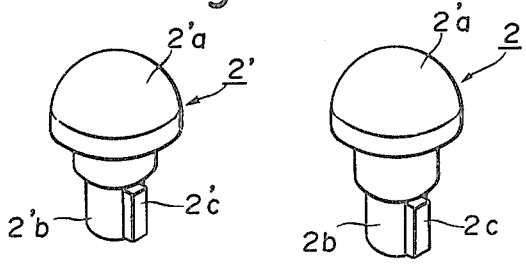
FIG. 3 is a perspective view of protrusions detachable from the pillow body.
Figure 9:
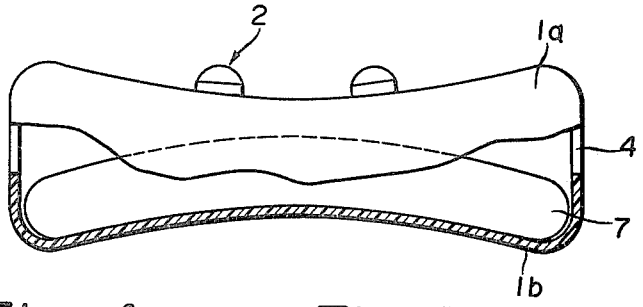
FIG. 9 is a side view of another embodiment of this invention, which is partly broken away.
Figure 4:
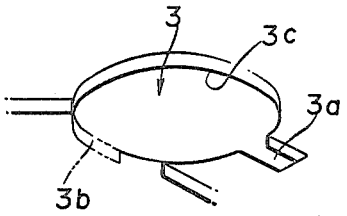
FIG. 4 is a perspective view of a part of the pillow, ie., hole for attaching the protrusion to the pillow body.
Figure 5:
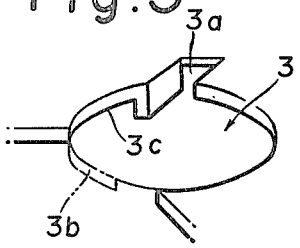
FIG. 5 is a perspective view of the modification of the attaching part.

FIG. 9 indicates the modification of the pillow, particularly to be modified as a cooling element. In this case, the lower member 1*b* includes a bag 7 accomodating material having large heat-capacity such as water.

Accordingly, the bag 7 is available as heat-absorber when the pillow is used as a cooling pillow in summer.

Another embodiment of the present invention is indicated in FIGS. 10 to 14. In this embodiment, the pillow comprises two parts, upper body 1*a* and lower body 1*b*. The upper body includes a saddle-shaped upper surface and a bottom plate 8 engaged to a belt edge 1*d* formed at the lower end of the upper body 1*a*. Said bottom plate 8 has a hollow-cylindrical joint member 9, which includes vertical slits 9*a*, at each corner thereof. The lower body 1*b* is made of metal, such as aluminum alloy or stainless steel for cooling the pillow. Said body includes cylindrical joint members 10 at each corner, so that each of joint members 10 inserts into the joint members 9 of the upper body 1*b* when the upper edge of said lower body 1*b* is engaged with the belt edge 1*d* of the upper body 1*a*, whereby the upper and lower bodies 1*a* and 1*b* are connected with each other.

Figure 13:
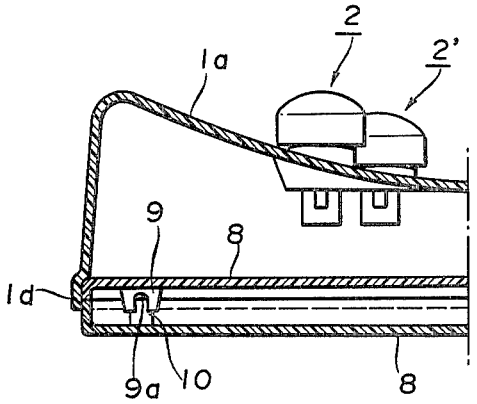
FIG. 13 is a vertical cross-section of the pillow assembled with a base member exchanged from a cooling pillow member.

In order to use the pillow as a manual therapeutics for human body, particularly to human body back portion, the lower body should be detached from the upper body 1*a* and alternatively, a base plate 11 is connected to the upper body 1*a* as shown in FIG. 13.

Accordingly, this embodiment has an advantage in that the lower body 1*b* can be used for cooling the human head in summer by reversing the pillow (show FIG. 14(*a*) ), the human head is set with its effected parts contacting the protrusion pieces 2 (2'), and the lowered pillow level is utilized for supporting the human back. Namely, the level of the pillow shown in FIG. 14(*a*) is capable of cooling the head by the pillow (FIG. 14(*b*) is available to finger-pressing effect), and the level of the pillower shown in FIG. 14(*c*) is capable of supporting the human back.

In this embodiment, the arrangement of the protrusion pieces 2(2') are non-linear and symmetrical, so that the human head is amended in the most effective therapeutics, in the condition that the head is fitted to a line surrounded by all the protrusion pieces 2(2').

The joint means in this embodiment may be deformed or exchanged for another device, for example, the tapered cylinderical pieces 12 provided to the bottom plate 8 so as to be arranged at the corners of a triangle, and a piece 13 provided to the upper portion of the cooling pillow member 1*b*. Accordingly, the opposite pieces 12 and 13 are mutually inserted as shown FIGS. 15 and 16.

In operation of these pillows, the user lies down on the bed with his head or body resting on the pillow disposed on the bed as shown in FIGS. 17 and 18. In this case, the supporting pieces 2 (2') are contact with his effected portions in a manner to be depressed by his own weight.

Accordingly, the user can simply and easily use the pillow for manual therapeutics by his own operation without medical care for finger-pressing threapeutics.

The pillow according to this invention, as already mentioned, can be used as a cooling pillow to induce comfortable sleeping in summer.

What is claimed is:

1. A pillow for manual therapeutics comprising:

a hollow body (1) including an upper body member (1*a*) having a surface portion for receiving and supporting at least a part of a human body, and a lower body member (1*b*) connected to said upper body member (1*a*);

at least one protrusion (2) detachably mounted on said receiving and supporting surface portion of said upper body member (1*a*);

said upper body member comprising at least one aperture, said at least one aperture being equal in number to the number of said at least one detachable protrusion, said at least one detachable protrusion (2) comprising a head portion (2*a*) and a leg portion (2*b*) connected to said head portion, said leg portion being introducable into said at least one aperture; and said at least one aperture further comprising a guide slit (3*a*) and said detachable protrusion (2) further comprising a lock protrusion (2*c*) extending from said leg portion (2*b*) of said at least one protrusion (2), said lock protrusion being passable through said guide slit when in alignment therewith, such that said detachable protrusion (2) is detachable from said hollow body (1) only when said lock protrusion (2*c*) is aligned with said guide slit (3*a*);

whereby when a human head or body part is supported on said hollow body, said at least one protrusion exerts pressure on at least a portion of the supported part of said head or body.

2. The pillow of claim 1 wherein said receiving and supporting surface portion of said upper body member (1*a*) is substantially saddle-shaped.

3. The pillow of claim 1 comprising heat radiant means (1*c*) attached to at least one wall of said hollow body (1).

4. The pillow of claim 3 wherein said heat radiant means comprises at least one fin (1*c*) extending from said at least one wall.

5. The pillow of claim 3 wherein said heat radiant means (1*c*) is attached to at least one inner wall of said hollow body (1) and said hollow body (1) has openings in at least one of said body members for allowing air circulation over said heat radiant means (1*c*).

6. The pillow of claim 5 wherein said heat radiant means comprises at least one fin (1*c*) extending from said at least one inner wall.

7. The pillow of claim 1 comprising a material having a high specific heat within said hollow body (1).

8. The pillow of claim 1 wherein said at least one protrusion (2) comprises a heating element (6).

9. The pillow of claim 8 wherein said heating element (6) is an electrical heating element, and further comprising electrical energizing means coupled to said heating element.

10. The pillow of claim 1 further comprises a tensioning means (5) coupled to said detachable protrusion (2) and adapted to contact said upper body member for biasing said head portion (2*a*) away from the receiving and supporting surface portion of said upper body member.

11. The pillow of claim 10 wherein said aperture (3) further comprises a step portion (3*b*) and a tapered portion (3*c*) integral to the wall of said aperture such that when said detachable protrusion (2) is inserted into said aperture and rotated with respect to said hollow body, said lock protrusion rides along said tapered portion until engaging said step portion where said tensioning means prevents return rotation of said detachable protrusion (2) without application of force overcoming the tensioning means, thereby preventing said detachable protrusion (2) from being unintentionally detached from said hollow body (1).

12. The pillow of claim 1 comprising a plurality of said protrusions on said receiving and supporting surface portion.

13. The pillow of claim 12 wherein said plurality of protrusions are symmetrically arranged.

14. The pillow of claim 12 wherein said plurality of protrusions are randomly arranged.

15. The pillow of claim 12 wherein said plurality of protrusions comprise protrusions having head portions of unequal height, said plurality of protrusions being arranged in substantially parallel rows, high protrusions being arranged in central portions of said rows, and shorter protrusions being arranged at end portions of said rows.

16. The pillow of claim 1 comprising means for fastening said upper body member (1*a*) to said lower body member (1*b*) at least in the vicinity of the peripheral edges thereof.

17. The pillow of claim 16 wherein:

said upper body member (1*a*) comprises a bottom member (8) on the underside of said upper body member (1*a*); and said means for fastening said upper body member (1*a*) to said lower body member (1*b*) comprises at least first and second mutually engageable joint members, said first mutually engageable joint member being attached to the underside of said bottom member (8), said second mutually engageable joint member being attached to the inner wall of said lower body member (1*b*) so that when said upper body member (1*a*) is aligned upon said lower body member (1*b*), said first and second mutually engageable joint members are engaged to prevent said upper body member (1*a*) from becoming detached from said lower body member (1*b*).

18. The pillow of claim 17 wherein one of said first and second joint members comprises a plurality of spaced apart tapered members (12), and the other of said first and second joint members comprises at least one tapered joint piece (13) arranged such that when said upper body member (1*a*) is aligned with said lower body member (1*b*), said at least one tapered joint piece (13) is inserted between opposing spaced apart tapered members (12) and in frictional contact with a plurality of said tapered members (12), whereby the upper body member (1*a*) and lower body member (1*b*) are fixedly connected together.

19. The pillow of claim 16 wherein said lower body member comprises a base plate member.

20. The pillow of claim 1 comprising six of said protrusions arranged substantially in a circle on said upper body member.

21. The pillow of claim 20 wherein at least two of said protrusions extend higher than the other protrusions, said protrusions all being symmetrically arranged about a center line of said pillow.

* * * * *

UNITED STATES PATENT AND TRADEMARK OFFICE

CERTIFICATE OF CORRECTION

PATENT NO. : 4,210,134

DATED : July 1, 1980

INVENTOR(S) : Yasukichi OKAZAKI et al

It is certified that error appears in the above-identified patent and that said Letters Patent are hereby corrected as shown below:

On the initial page of the patent, under the heading of Foreign Application Priority Data, change "March 30, 1978" to --March 9,1978--;

Column 1, line 19, before "protrusions detach-" insert --the--.

Signed and Sealed this

*Thirtieth* Day of *December 1980*

[SEAL]

*Attest:*

SIDNEY A. DIAMOND

*Attesting Officer*

*Commissioner of Patents and Trademarks*